US009850031B2

(12) United States Patent
Brown

(10) Patent No.: US 9,850,031 B2
(45) Date of Patent: Dec. 26, 2017

(54) SIMULATED COMMERCIAL ENVELOPES AND METHODS OF MAKING THE SAME

(75) Inventor: Philip Medwell Brown, Libertyville, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 13/569,705

(22) Filed: Aug. 8, 2012

(65) Prior Publication Data

US 2013/0026216 A1 Jan. 31, 2013

Related U.S. Application Data

(63) Continuation of application No. 12/163,177, filed on Jun. 27, 2008, now Pat. No. 8,256,194.

(51) Int. Cl.
*B65D 27/00* (2006.01)
*B65D 27/14* (2006.01)

(52) U.S. Cl.
CPC ..... *B65D 27/00* (2013.01); *B65D 27/14* (2013.01)

(58) Field of Classification Search
CPC ..... B65D 27/06; B65D 27/04; B65D 27/08; B65D 27/00; B65D 27/14; B31B 2221/05; B31B 2221/10
USPC ..... 229/70, 72, 75, 300–302
See application file for complete search history.

(56) References Cited

U.S. PATENT DOCUMENTS 659,788 A * 10/1900 Callahan ..... 229/68.1
913,919 A * 3/1909 Sales ..... 229/302
1,205,100 A * 11/1916 Marston et al. ..... 229/71
1,387,784 A * 8/1921 Levaur ..... 229/71
1,439,637 A * 12/1922 Pepin ..... 229/71
1,476,495 A * 12/1923 Cross ..... 229/80
2,055,716 A * 9/1936 Berkowitz ..... 229/72
2,067,948 A * 1/1937 Potdevin ..... 383/123
2,268,795 A * 1/1942 Berkowitz ..... 229/72
2,289,118 A * 7/1942 Hatton ..... 229/68.1
2,840,296 A 6/1958 Fromm
2,843,310 A * 7/1958 Hopkins ..... 229/72
2,858,061 A 10/1958 Fromm et al.
3,150,473 A * 9/1964 Lemelson ..... 53/412
3,399,824 A * 9/1968 Dodge ..... 229/72
(Continued)

OTHER PUBLICATIONS

United States Patent and Trademark Office, "Notice of Allowance," issued in connection with U.S. Appl. No. 12/163,177, on May 9, 2012 (13 pages).

(Continued)

*Primary Examiner* — Peter Helvey
(74) *Attorney, Agent, or Firm* — McCracken & Gillen LLC

(57) ABSTRACT

Simulated commercial envelopes and methods of making are disclosed. An example envelope includes a first envelope portion having a front panel. A top flap is integrally formed with a top edge of the front panel about a first fold line, and a bottom flap is integrally formed with a bottom edge-of the front panel about a second fold line. A second envelope portion includes a rear panel free of any fold lines or flaps. The rear panel is to be secured to the front panel to form a pocket at least partially surrounding the mailer. The bottom flap is to be folded about the second fold line and to be secured to the rear panel on a side opposite the formed pocket. The top flap is to be folded about the first fold line and to be secured over the rear panel on the side opposite the formed pocket.

30 Claims, 6 Drawing Sheets

(56) References Cited

U.S. PATENT DOCUMENTS

| | | | | | |
|---|---|---|---|---|---|
| 3,457,696 | A | * | 7/1969 | Berkley | 53/460 |
| 3,550,841 | A | * | 12/1970 | Berkley | 229/71 |
| 3,580,488 | A | * | 5/1971 | Komen | 229/69 |
| 3,593,912 | A | * | 7/1971 | Collura et al. | 229/71 |
| 3,618,284 | A | | 11/1971 | Gendron | |
| 3,618,596 | A | | 11/1971 | Miller | |
| 3,634,994 | A | | 1/1972 | Dunne | |
| 3,643,858 | A | * | 2/1972 | Deckys | 229/72 |
| 3,786,984 | A | * | 1/1974 | Malenge | 229/69 |
| 4,084,741 | A | * | 4/1978 | Heimann | 229/69 |
| 4,091,596 | A | | 5/1978 | Jones | |
| 4,134,322 | A | | 1/1979 | Lillibridge | |
| 4,173,922 | A | | 11/1979 | Helm | |
| 4,354,631 | A | | 10/1982 | Stevenson | |
| 4,382,539 | A | * | 5/1983 | Kronman | 229/302 |
| 4,411,643 | A | | 10/1983 | Higginson | |
| 4,487,360 | A | | 12/1984 | Fisher et al. | |
| 4,570,416 | A | * | 2/1986 | Shoenfeld | 53/415 |
| 4,586,651 | A | | 5/1986 | Bradley | |
| 4,730,767 | A | * | 3/1988 | Gendron | 229/305 |
| 4,807,805 | A | | 2/1989 | Rutkowski | |
| 4,890,788 | A | * | 1/1990 | Pennock | 229/71 |
| 5,005,758 | A | | 4/1991 | Richards et al. | |
| 5,040,720 | A | | 8/1991 | Pennock | |
| 5,041,072 | A | | 8/1991 | McClelland | |
| 5,092,515 | A | | 3/1992 | Murray | |
| 5,201,982 | A | | 4/1993 | Schmidt | |
| 5,316,208 | A | * | 5/1994 | Petkovsek | 229/71 |
| 5,411,201 | A | * | 5/1995 | Petkovsek | 229/71 |
| 5,568,717 | A | | 10/1996 | Harrod | |
| 5,626,281 | A | | 5/1997 | Bloom | |
| 6,041,999 | A | * | 3/2000 | Petkovsek | 229/300 |
| 6,192,661 | B1 | | 2/2001 | Bodart et al. | |
| 6,402,015 | B1 | | 6/2002 | Collins | |
| 7,854,369 | B2 | | 12/2010 | Keefe | |
| 8,256,194 | B2 | * | 9/2012 | Brown | 53/460 |
| 2002/0100797 | A1 | | 8/2002 | Hollingsworth et al. | |
| 2007/0051780 | A1 | | 3/2007 | Andersen et al. | |
| 2009/0321502 | A1 | | 12/2009 | Brown | |

OTHER PUBLICATIONS

United States Patent and Trademark Office, "Advisory Action," issued in connection with U.S. Appl. No. 12/163,177, on Jan. 27, 2012 (2 pages).

United States Patent and Trademark Office, "Final Office Action," issued in connection with U.S. Appl. No. 12/163,177, on Nov. 17, 2011 (15 pages).

United States Patent and Trademark Office, "Non-Final Office Action," issued in connection with U.S. Appl. No. 12/163,177, on Jun. 10, 2011 (17 pages).

* cited by examiner

SIMULATED COMMERCIAL ENVELOPES AND METHODS OF MAKING THE SAME

RELATED APPLICATION

This patent arises from a continuation of U.S. patent application Ser. No. 12/163,177, filed Jun. 27, 2008, which is hereby incorporated herein by reference in its entirety.

FIELD OF THE DISCLOSURE

The present disclosure relates generally to envelopes and more particularly, to simulated commercial envelopes and methods of making the same.

BACKGROUND OF RELATED ART

Mass produced integrated mailing envelopes are typically formed from webs of paper stock moving through inline presses. The inline presses create mail kits by integrating the envelope and internal components all in one print finishing process. For instance, a plurality of interconnected envelope blanks are formed from a web of paper. The integrated envelope is formed by sequentially applying adhesive to the edge and sides of the bottom flap and plow folding the flap over the main body. The top flap is then plow folded over both the main body and the bottom flap to seal the envelope. The resultant envelope is oftentimes readily recognized as a mass mailing by the characteristic rectangular envelope back, lacking the familiar angled flaps and edges of conventional commercial envelopes.

Conventional commercial envelopes, however, are typically manufactured from a single envelope sheet. This sheet is typically first printed in a web press, sheeted, and finally die cut to create a multi-sided envelope blank. An example commercial envelope includes a main body portion, a pair of oppositely located side flaps, a bottom flap, and a top flap. During manufacturing, the side flaps and bottom flap are glued, folded and sealed together to form the envelope, and the top flap is provided with a glue. Because of the required assembly steps, including multi-sided folding, commercial envelopes are not conducive to inline press manufacturing used in the integrated process.

DETAILED DESCRIPTION

Figure 1:
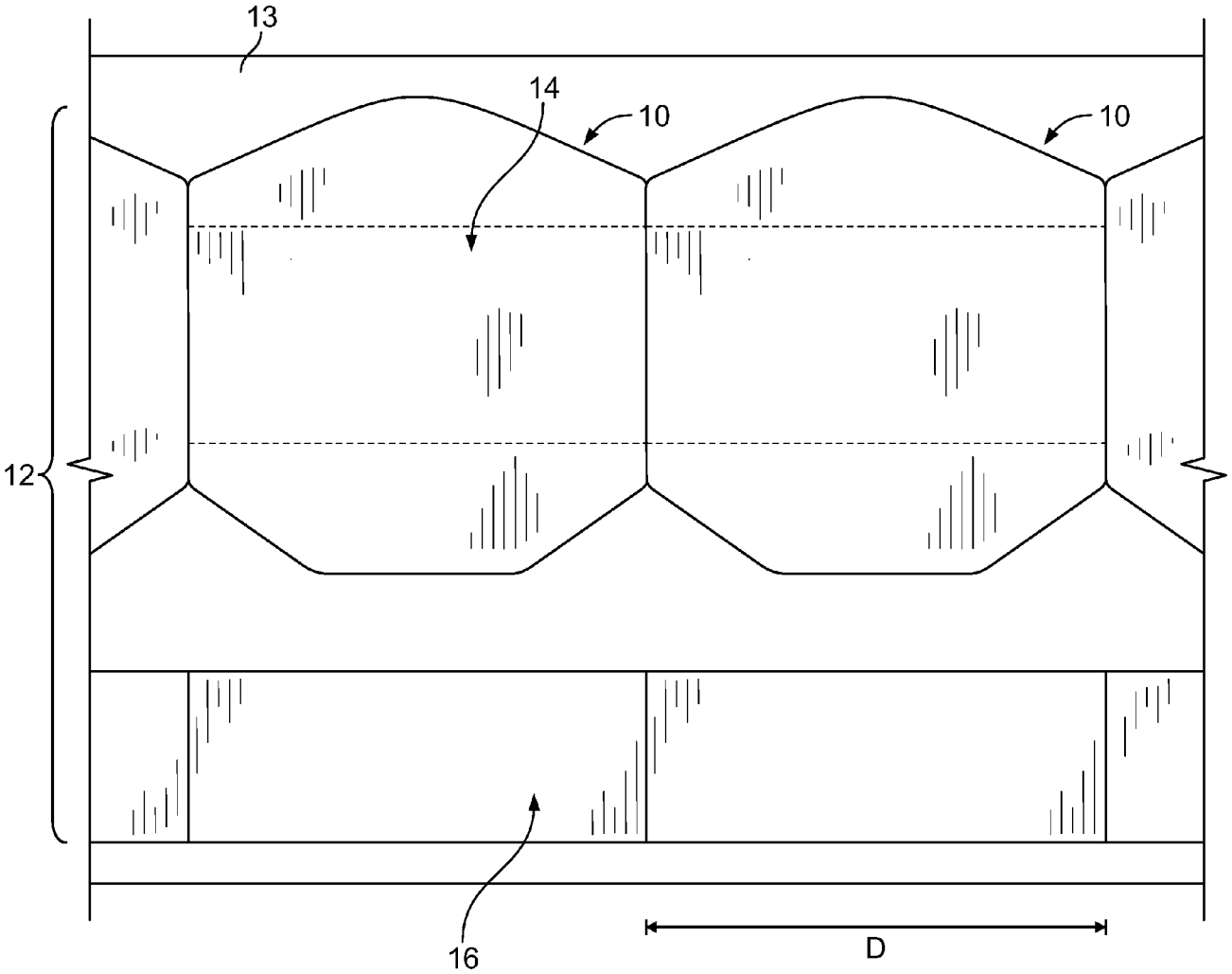
FIG. 1 is a plan view of an example paper stock illustrating a plurality of two-piece envelope blanks.
Figure 2:
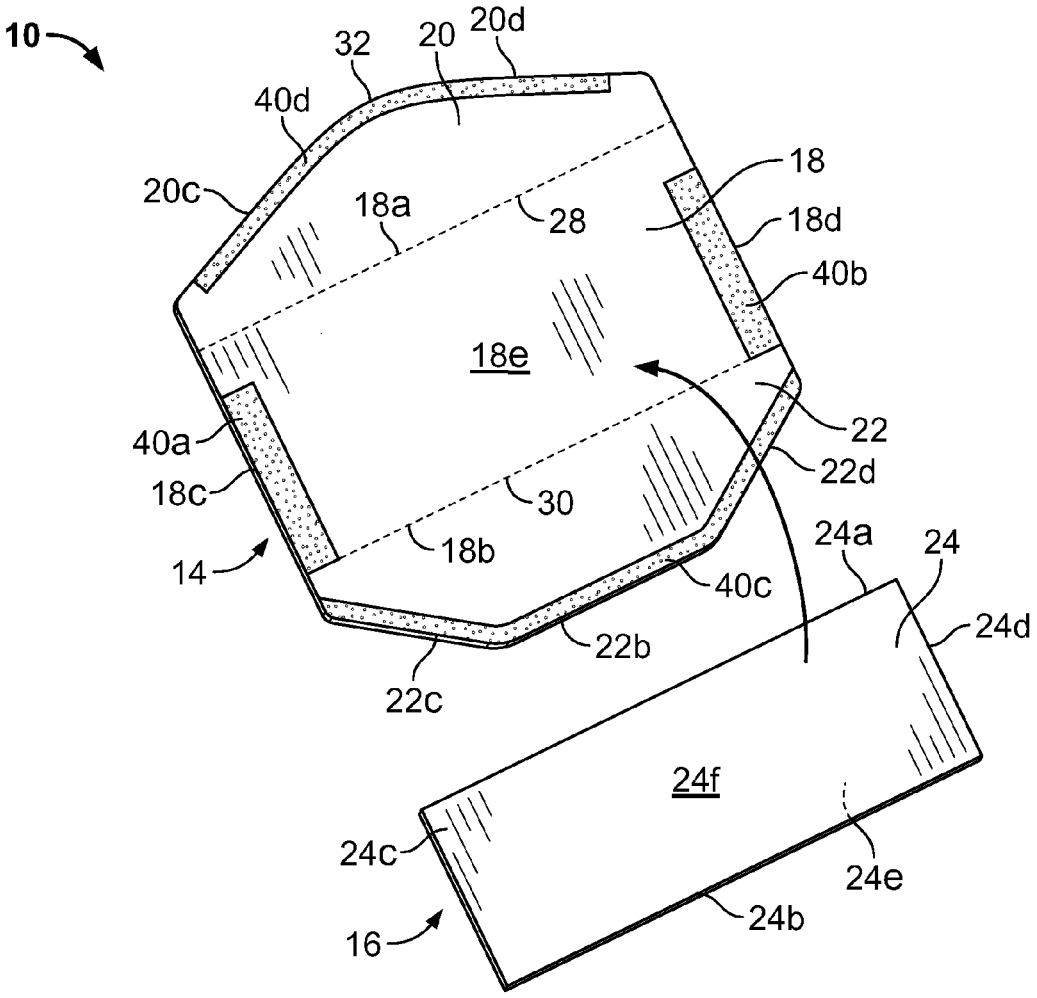
FIG. 2 is a perspective view of the example two-piece envelope blank of FIG. 1, showing the blanks, in particular a rear panel and a front panel, removed from the paper stock prior to assembly.

FIG. 1 illustrates a plurality of example envelopes 10 prior to assembly. In this example, each of the envelopes 10 are prepared from a two-piece envelope blank 12 that is removed from a paper stock, such as, for example a paper web 13. The example envelope blank 12 includes a first envelope portion 14 and a second envelope portion 16. The envelope blank 12 may be removed from the paper web 13 by any suitable manner, including, for example, die cutting. As illustrated, multiple envelopes 10 may be removed from the paper web 13 during manufacture. Furthermore, while the first and second envelope portions 14 and 16 are illustrated as being formed from a single web 14, the envelope portions 14 and 16 may be formed from separate webs and/or from webs separately formed from a single web (e.g., split from a single web). Still further, all, or a portion of, the blank 12 may be removed from the web 14 at any time during assembly of the envelope 10. The example paper web 13 is adapted to move through a single direction inline web assembly press parallel to the arrow D as shown.

Referring to FIGS. 2-5, the example envelope 10 is illustrated as removed from the web 13. In this example, the envelope 10 is prepared from the two piece envelope blank 12 that includes the first envelope portion 14 and the second envelope portion 16. Specifically, the example first envelope portion 14 includes a front panel 18, a top flap 20, and a bottom flap 22. The example second envelope portion 16 includes a rear panel 24. Each of the example front panel 18 and rear panel 24 are generally rectangular in shape and are of substantially the same width and height. In particular, in this example the front panel 18 and the rear panel 24 are each approximately ten inches in width and four inches in height. The width and/or the height of each of the front panel 18 and the rear panel 24, however, may vary as desired. Furthermore, the height of the front panel 18 may be different than the height of the rear panel 24.

As illustrated, the example front panel 18 includes a top edge 18*a*, and a parallel bottom edge 18*b*, connected by a pair of side edges 18*c* and 18*d*. The example rear panel 24 similarly includes a top edge 24*a*, and a parallel bottom edge 24*b*, connected by a pair of side edges 24*c* and 24*d*. The front panel portion 18 has an inner surface 18*e* which lies in confronting relationship with an inner surface 24*e* of the rear panel 24 after the envelope 10 is assembled as described below. Further, the example top flap 20 and the bottom flap 22 are integrally formed with the top edge 18*a* and the bottom edge 18*b* of the front panel 18 about respective fold lines 28 and 30. As shown, the example fold lines 28 and 30 are parallel to both the top edge 18*a* and the bottom edge 18*b*, and are, therefore, parallel to each other. The side edges 18*c* and 18*d* are free from any fold lines, flaps, or other appendages.

Each of the example top flap 20 and bottom flap 22 includes a generally triangular shaped portion. For instance, in this example the top flap 20 includes a first side edge 20*c* and a second side edge 20*d* extending from the side edges 18*c* and 18*d* of the front panel 18 respectively. The side edge

20*c* extends from the intersection of the edge 18*c* and the top edge 18*a*, extending upward and convergently towards an apex 32 formed by the intersection of the side edges 20*c* and 20*d*. The side edge 20*d* extends from the intersection of the edge 18*d* and the top edge 18*a*, extending upward to the apex 32. The size and/or shape of the top flap 20 may vary as desired. In this example, the distance between the apex 32 and the top edge 18*a* is approximately two inches.

Similarly, the bottom flap 22 includes a first side edge 22*c* and a second side edge 22*d* extending from the side edges 18*c* and 18*d* of the front panel 18 respectively. In this example, the side edge 22*c* extends from the intersection of the edge 18*c* and the bottom edge 18*b* opposite the top flap 20. The side edge 22*d* extends from the intersection of the edge 18*d* and the bottom edge 18*b*. Both side edges 22*c* and 22*d* extend downward and converge toward a bottom edge 22*b*. The bottom edge 22*c* is generally parallel to the bottom edge 18*b* of the front panel 18. In other examples, the side edges 22*c* and 22*d* may extend to an apex (not shown) thereby eliminating the bottom edge 22*b*. The size and/or shape of the bottom flap 22 may vary as desired. In this example, the distance between the bottom edge 22*b* and the bottom edge 18*b* is approximately three and one half inches.

The example front panel portion 18 is provided with a plurality of adhesive regions for assembling the envelope 10 as will be described in detail below. For example, the example front panel portion 18 includes a first adhesive region 40*a* and a second adhesive region 40*b* for securing the rear side panel portion 24 to the front side panel portion 18. A third adhesive region 40*c* is provided for securing the bottom flap 22 to an outer surface 24*f* of the rear panel 24, and a third adhesive region 40*d* for securing the top flap 20 to the outer surface 24*f* of the rear panel 24 or to an outer surface of the bottom flap 22, after the envelope 10 is assembled. Each of the adhesive portions 40*a*-40*d* may be any suitable fastener and/or adhesive, including, for example, permanent, semi-permanent, or releasable adhesive, or other suitable arrangement. While the adhesive portions 40*a*-40*d* are illustrated as contiguous regions, the adhesive portions may be placed in any suitable pattern, arrangement and/or location. For instance, while the adhesive portions 40*a*-40*d* are illustrated as being located on the inner surface 18*e* of the front panel portion 18, any or all of the adhesive portions 40*a*-40*d* may be located on the corresponding surface of the rear panel 24, or may alternatively be located on both surfaces.

Referring to FIGS. 2-5, two example assembly processes of the envelope 10 are shown. The example assembly processes may be performed by a high speed inline web assembly press (not shown), or other suitable automated and/or manual process.

Figure 3A:
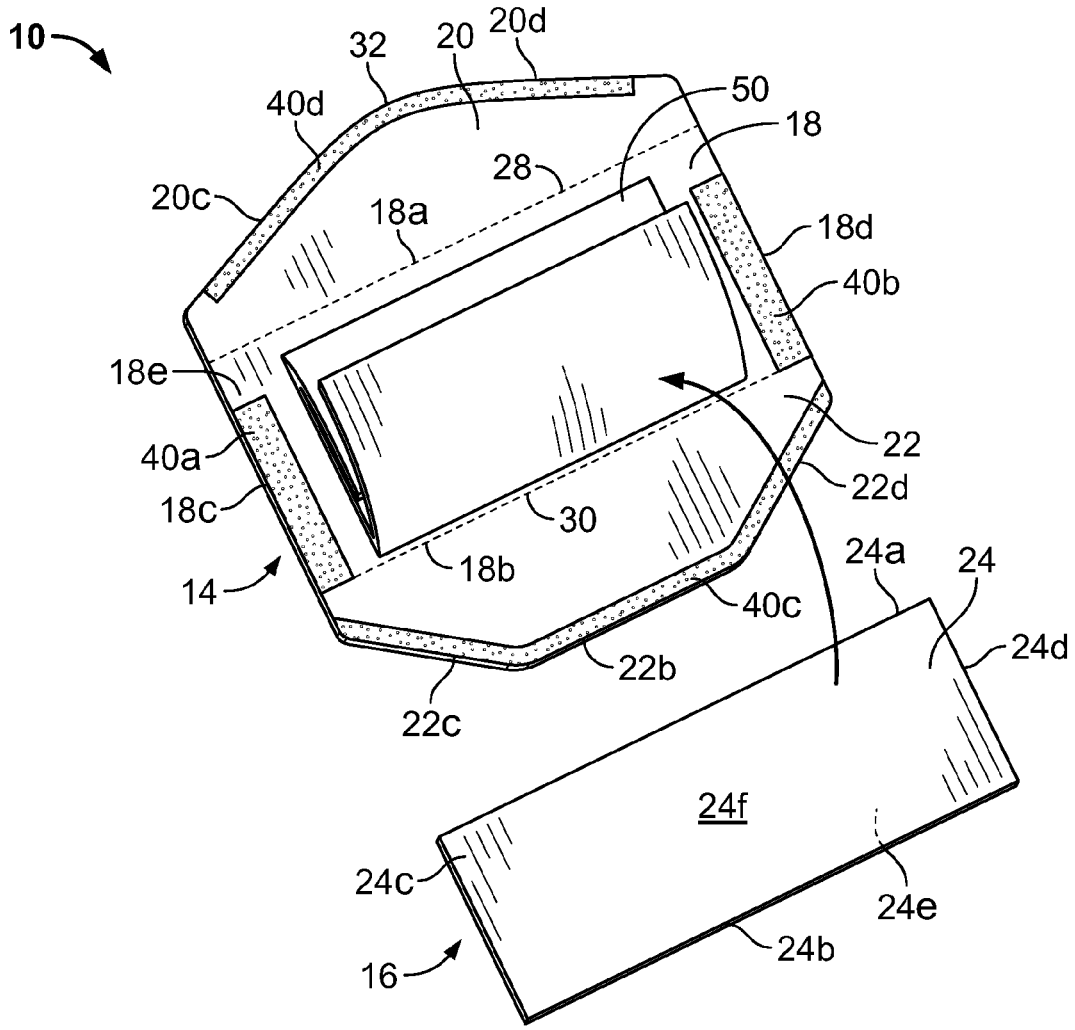
FIG. 3A is a perspective view of the example envelope of FIG. 2, showing a mailing insert being placed on a front panel of the envelope blank and being covered by the rear panel.

In one method of forming the envelope 10, a preformed mailer insert 50 is first aligned with and placed in proximity to the front panel portion 18 of the first envelope portion 14 as shown in FIG. 3A. The mailer insert 50 will thus lie in confronting relationship with the inner surface 18*e*. The mailer insert 50 will not overlap the adhesive layers 40*a* or 40*b*, allowing for removal of the insert 50 later by a recipient of the envelope 10. The mailer insert 50 may be any type of insert (e.g. a letter, card, billing statement, advertisement, etc.), separately or concurrently formed, and sized and/or folded for placing onto the inner surface 18*e*. In the illustrated examples, the mailer insert 50 is a folded paper mailer.

After placement of the mailer insert 50, the rear panel 24 is aligned with and mounted to the front panel portion 18 of the first envelope portion 14, at least partially covering the mailer insert 50, such that the inner surface 24*e* lies in confronting relationship with the mailer insert 50. The rear panel portion 24 is secured to (i.e. adhered to) the front panel portion 18 by, for example, the adhesive layers 40*a* and 40*b*.

Figure 3B:
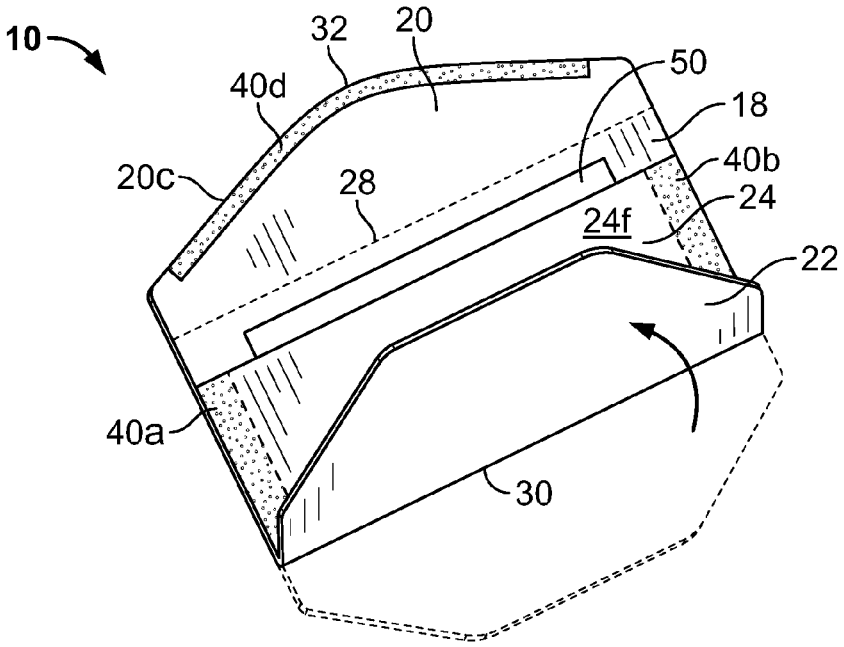
FIG. 3B is a perspective view of the example envelope blank of FIG. 1, showing a rear panel of the envelope blank secured to the front panel of the envelope blank and showing a bottom flap being folded over the rear panel. [here]
Figure 3C:
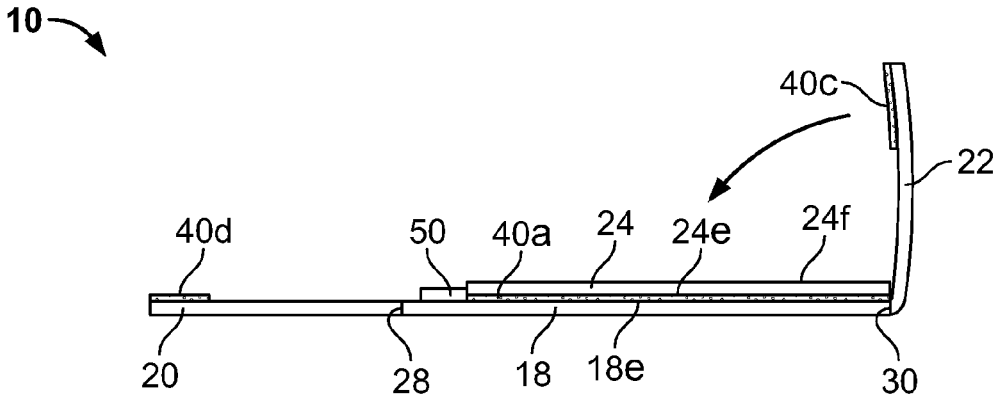
FIG. 3C is a side view of the example envelope, of FIG. 3B, showing the example envelope partially folded.

The bottom flap 22 is then folded over the outer surface 24*f* of the rear panel portion 24 as shown in FIGS. 3B-3C. The folding may be performed by, for example, plow folding the bottom flap 22 in the inline assembly press. The illustrated bottom flap 22 covers at least a portion of the outer surface 24*f* of the rear panel portion 24, but also leaves at least a portion of the outer surface 24*f* uncovered. The bottom flap 22 could cover the outer surface 24*f*.

Figure 4:
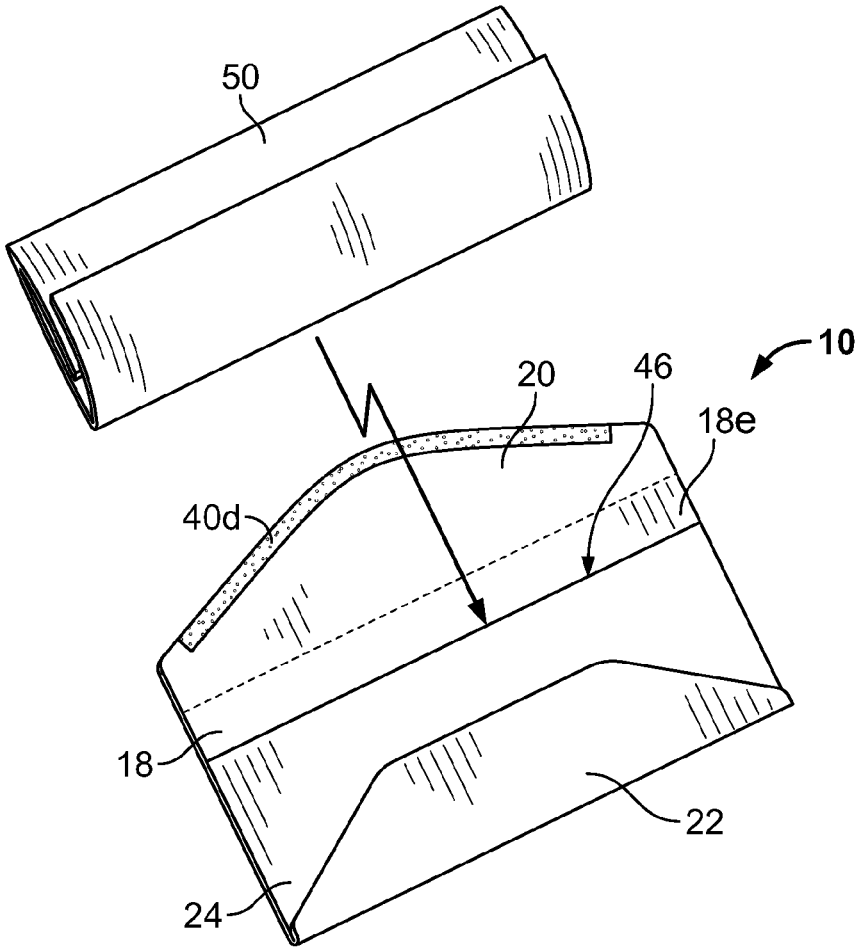
FIG. 4 is a perspective view of the example envelope of FIG. 2, showing another assembly example wherein the bottom flap has been folded over the rear panel and a mailing insert is placed between the front panel and the rear panel.

In another example method of forming the envelope 10, shown in FIG. 4, the mailer insert 50 is placed into an already formed pocket 46 bounded on three sides. In particular, the pocket 46 is formed between the rear panel portion 24 and the front panel portion 18 by the adhesion of the rear panel portion 24 to the front panel portion 18 and by the folding of the bottom flap 22. As with the previous example, the mailer insert 50 will not overlap the adhesive layers 40*a* or 40*b*.

In either example, the mailer insert 50 may be placed on the inner surface 18*e* or inserted into the pocket 46 in any suitable manner. For instance, the mailer insert 50 may be placed in cooperative relationship with either the front panel portion 18 or the rear panel portion 24 prior to the formation of the pocket 46 and the pocket 46 may be subsequently formed around the mailer insert 50 during the inline process (FIG. 3A), or the example mailer insert 50 may be inserted into the pocket 46 after the formation of the pocket 46 (FIG. 4). This may be achieved by, for example, a secondary offline inserting process.

Figure 5:
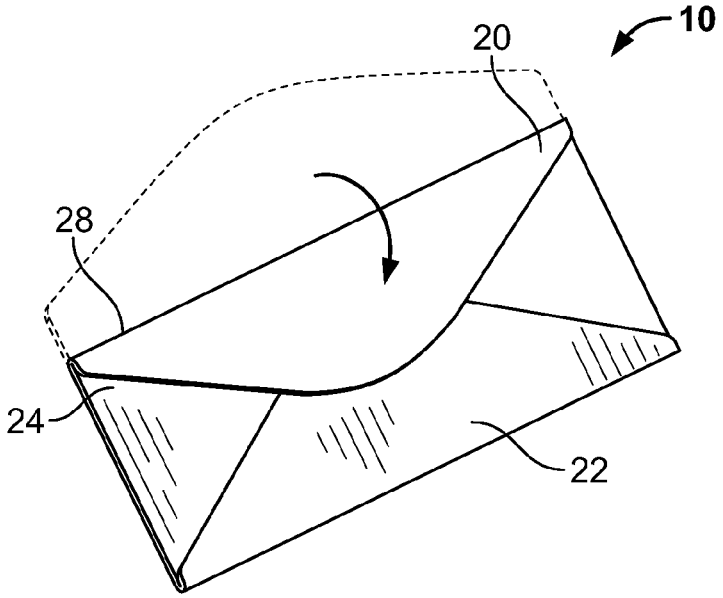
FIG. 5 is a perspective view of the example envelope of FIG. 2, showing the top flap after the top flap has been folded over the rear panel to close the envelope.

Turning now to FIG. 5, after the mailer insert 50 is assembled within the envelope 10, the top flap 20 is folded about the fold line 28 and the envelope 10 is ready for subsequent sealing. The top flap 20 may be folded, for example, by plow folding the top flap 20 about the fold line 28, such as, for instance, during the inline press assembly. Similar to the bottom flap 22, the top flap 20 covers at least a portion of the outer surface 24*f* of the rear panel portion 24. As illustrated, in this example, the top flap 22 covers a portion of the bottom flap 22 when folded. The top flap 22, however, may not cover a portion of the bottom flap 22 when folded. With both the bottom flap 22 and the top flap 20 folded, however, at least a portion of the outer surface 24*f* of the rear panel portion 24 remains uncovered. In this manner, the back side of the assembled envelope 10 has the appearance of a standard commercial envelope. The top flap 20 may be folded and left un-sealed for later processing and/or sealing as desired. Any or all of the assembly steps may be performed by an automated process, a manual process, or a combination of both.

Figure 6:
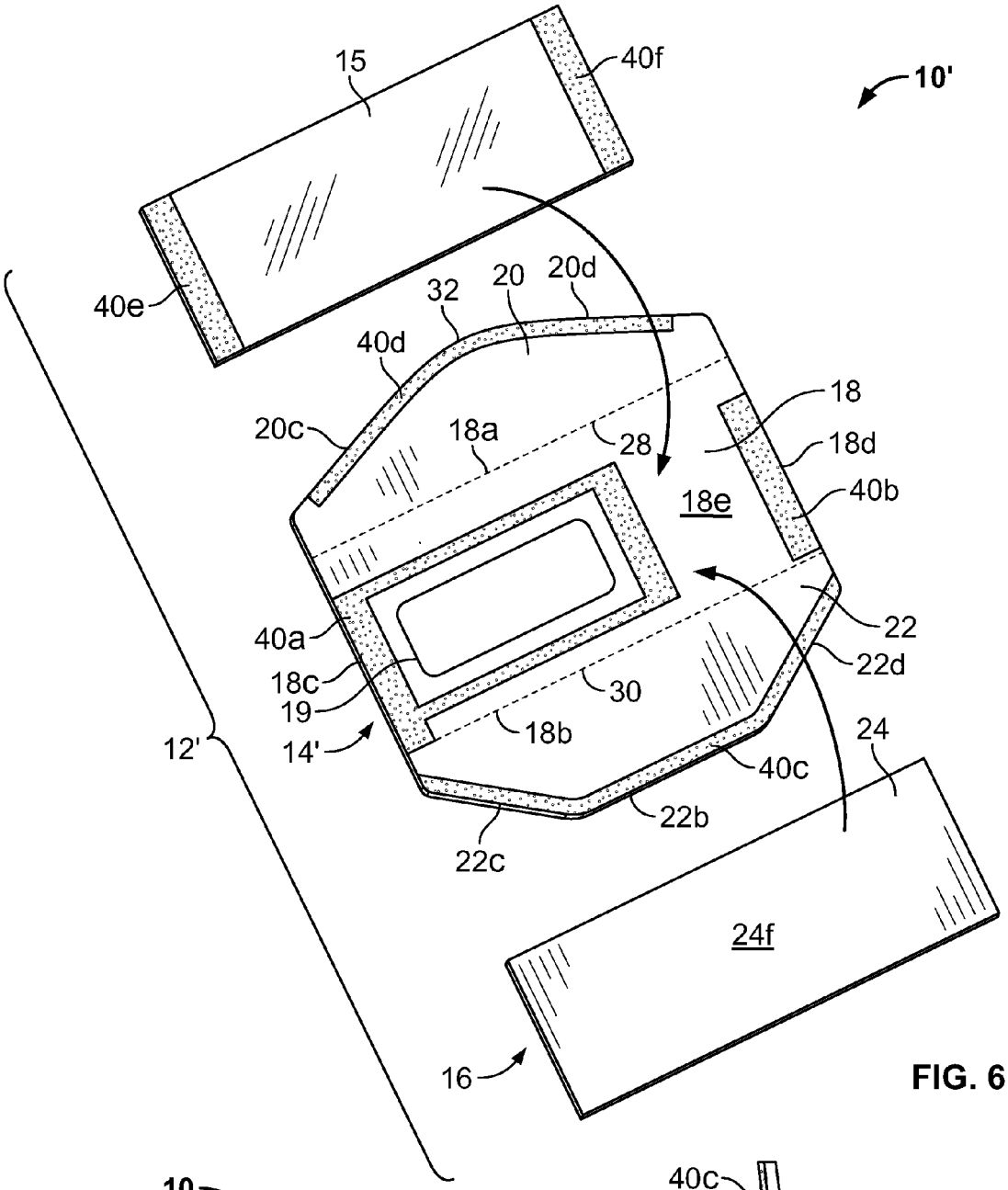
FIG. 6 is a perspective view of another example envelope blank, showing a transparent window film, and its placement on the envelope front panel.
Figure 7:
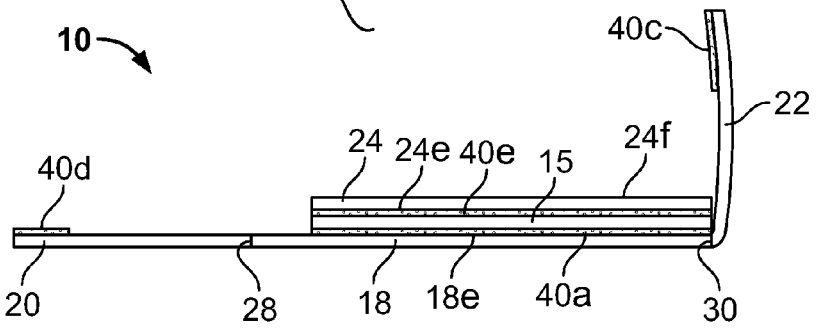
FIG. 7 is a side view of the example envelope, of FIG. 6, showing the example envelope partially folded.

Turning now to FIG. 6, there is illustrated another example envelope 10' similar to the envelope 10. The envelope 10' of FIG. 6 has many similarities to the envelope 10. Thus, to avoid redundancy, structures appearing in the envelope 10 are not again discussed in detail in the following description of the example envelope 10'. Instead, the intended reader is referred back to the description of the example envelope 10 for a complete description of those components. To facilitate such an effect, like reference numbers are used to reference like structures in the example envelope 10, 10'.

The example envelope 10' of FIG. 6 is prepared from a similar two-piece envelope blank 12', but also includes a transparent window film 15. In this example, the front panel portion 18 includes at least one window 19 formed through the panel 18, sized and located for a mailing address and/or other information to be displayed therethrough. For example, the window 19 may allow a mailing address located on the mailer insert 50 to be displayed.

In this example, the window film 15 is placed over the address window 19 and adhered to the inner surface 18*e* of the front panel portion 18. For instance, as illustrated the adhesive 40*a* is extended around at least a portion of the address window 19 and a first side of the window film 15 is adhered thereto. While the window film 15 may be sized to correspond generally to the size of the address window 19, (i.e., only covers the window 19), in this example the window film 15 extends substantially the same width as the front panel portion 18. The window film 15, however, may be sized as desired. In this illustrated example, the window film 15 is secured to the front panel portion 18 by at least a portion of the adhesives 40*a* and 40*b*. Accordingly, an adhesive 40*e* and 40*f* and/or other suitable fastener is included on the second side of the window film 15 to secure the rear panel portion 24 to the window film 15. Thus, the example pocket 46 is formed between the window film 15 and the rear panel portion 24.

As noted above, the window film 15 may be any suitable size and/or shape. For example, the window film 15 may be sized to substantially correspond to the shape of the address window 19 and blown on as a patch. Alternatively, the window film 15 may be larger or smaller than the address window 19. Furthermore, as in this example, the window film 15 may include an adhesive 40*e*, 40*f* to assist in the securement of the rear panel portion 24 to the front panel portion 18, and the adhesive 40*e*, 40*f* may be any pattern as desired, or may be eliminated entirely. Additionally, the window film 15 may be completely eliminated from the envelope 10' and the address window 19 left uncovered.

Because previous envelopes manufactured by an inline press typically included a plurality of flaps that are not perpendicular to the direction of travel of the envelope through an inline press, the manufacturing of the envelope required a change of direction to properly process folds. A change of direction in the inline manufacturing process, however, leads to an increase in space, cost, complexity, and/or time, thus slowing the manufacturing process and/or making the process more costly and/or impractical. For example, to plow fold a piece of paper in an inline press, the paper must be traveling in a direction parallel to the fold. Accordingly, envelope assemblies that include flaps with fold lines perpendicular to the direction of travel require a change of direction to properly plow fold the flap. This change of direction increases the complexity of the press assembly, results in slower processing speeds, and is not conducive to large mailing projects that rely upon very fast and efficient processing times.

Furthermore, the characteristic rectangular envelope formed by typical inline press assemblies oftentimes is easily recognizable by a customer as a mass mailing envelope. This mass mailing classification may have negative connotations to the recipient, even when the mailing is highly relevant to the consumer. In some instances, the consumer may choose not to open the mailing, or delay doing so, simply as a result of the appearance of the mailing piece. Thus, producers of mass mailing projects desire a mailer that may be produced quickly and efficiently, while resulting in an envelope that has the appearance of a business mailer.

The example envelopes 10, 10' described herein present the appearance of a commercial envelope, while allowing the envelopes 10, 10' to be mass produced at typical inline press speeds. In particular, the example envelopes 10, 10' include flaps and fold lines that are parallel to the direction of travel of the envelopes 10, 10' within the inline press. The envelopes 10, 10' are processed in a single direction through the inline press, allowing the press to run at a normal process rate, suitable for large mailing projects. Additionally, the appearance of the example envelopes 10, 10' mimic that of a traditional commercial envelope. In particular, the example envelopes 10, 10' are produced with a quickly recognizable commercial, or "diaper" envelope back.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

I claim:

1. An envelope comprising:

a first substrate including an envelope portion including:

a front panel including a top edge and a bottom edge parallel to the top edge, the top and bottom edges being connected by a pair of side edges, wherein the said edges form portions of a perimeter of the first substrate, a top flap integrally formed with the top edge of the front panel about a first fold line, a bottom flap integrally formed with the bottom edge of the front panel about a second fold line, the front panel being free of any fold lines or flaps between the pair of side edges and between the first fold line and the second fold line; and a second substrate separate from the first substrate, the second substrate including a second envelope portion having a rear panel to be secured to the front panel to form a pocket therebetween, the bottom flap to fold about the second fold line and to be secured to the rear panel on a side opposite the formed pocket, the top flap to fold about the first fold line and to be secured over the rear panel on the side opposite the formed pocket, and a first adhesive is disposed on at least a portion of a perimeter edge of the bottom flap to directly adhere the bottom flap to the rear panel, and a second adhesive is disposed between the side edges of the front panel to secure the front panel to the rear panel.

2. An envelope as defined in claim 1, wherein at least one of the top flap or the bottom flap includes a pair of convergent side edges.

3. An envelope as defined in claim 1, wherein at least one of the top flap or the bottom flap includes a generally triangular shaped portion.

4. An envelope as defined in claim 1, wherein the second adhesive extends proximate and along at least a portion of the side edges of the front panel.

5. An envelope as defined in claim 1, wherein the top flap is secured to at least a portion of the bottom flap.

6. An envelope as defined in claim 1, wherein the top flap and the bottom flap together do not cover at least a portion of the rear panel.

7. An envelope as defined in claim 1, wherein the second adhesive extends along at least a portion of the perimeter of the front panel.

8. An envelope as defined in claim 1, wherein the front panel includes an address window formed therethrough.

9. An envelope as defined in claim 8, further including a transparent window film disposed between the rear panel and the front panel and covering the address window.

10. An envelope as defined in claim 1, wherein the top flap includes a pentagonal shape and the bottom flap includes a hexagonal shape.

11. An envelope as defined in claim 1, wherein the bottom flap includes an edge substantially parallel to the second fold line, a corner of the top flap to at least partially cover the edge when the bottom and top flaps are secured to the rear panel.

12. An envelope as defined in claim 1, wherein the first envelope portion is asymmetrical about an axis.

13. An envelope as defined in claim 1, wherein the envelope portion is asymmetrical about an axis before folding the bottom and top flaps and the envelope portion is symmetrical about the axis after folding the bottom and top flaps.

14. An envelope including a mailer comprising:

a first envelope portion including:

a front panel including a top edge, and a bottom edge parallel to the top edge and a pair of side edges that form portions of the perimeter of the first envelope portion, a top flap integrally formed with the top edge of the front panel about a first fold line, the top flap and the front panel sharing the first fold line, and a bottom flap integrally formed with the bottom edge of the front panel about a second fold line; and a second envelope portion separate from the first envelope portion and including a rear panel directly secured to the front panel between the pair of side edges to form a pocket at least partially surrounding the mailer;

wherein the front panel is free of any fold lines or flaps between the pair of side edges and between the first fold line and the second fold line, the bottom flap and the front panel sharing the second fold line, the top flap free of any fold lines or flaps between the first fold line and a first perimeter edge of the top flap, the bottom flap being free of any fold lines or flaps between the second fold line and a second perimeter edge of the bottom flap;

the bottom flap folded about the second fold line and directly adhered to the rear panel on a side opposite the formed pocket; and the top flap folded about the first fold line and secured over the rear panel on the side opposite the formed pocket.

15. An envelope as defined in claim 14, further including a transparent window film to be secured between the rear panel and the front panel and covering an address window.

16. An envelope as defined in claim 15, wherein the front panel includes the address window.

17. An envelope as defined in claim 14, wherein the mailer is not adhered to either the first envelope portion or the second envelope portion.

18. An envelope as defined in claim 14, wherein the first envelope portion and the second envelope portion have the same width.

19. An envelope as defined in claim 14, wherein the first envelope portion and the second envelope portion are formed from a single web of substrate.

20. An envelope as defined in claim 1, wherein the second adhesive is closer to the second fold line than the first fold line.

21. An envelope as defined claim 1, wherein the second adhesive is immediately adjacent or engages the second fold line, the second adhesive is spaced from the first fold line.

22. An envelope as defined in claim 1, wherein the first and second fold lines include perforations.

23. An envelope as defined in claim 1, wherein the first adhesive on the bottom flap is spaced from the second fold line.

24. An envelope as defined in claim 10, wherein the first adhesive is disposed on at least three sides of the bottom flap.

25. An envelope as defined in claim 1, wherein the first envelope portion has a hexagonal shape.

26. An envelope as defined in claim 25, further including a third adhesive on at least a portion of a perimeter edge of the top flap, wherein the adhesive on the bottom flap and the third adhesive on the top flap are disposed on five sides of the hexagonal shape.

27. An envelope as defined in claim 1, wherein the rear panel is free of any fold lines or flaps.

28. An envelope as defined in claim 1, wherein the first substrate is made of a first material and the second substrate is made of the first material.

29. An envelope as defined in claim 1, wherein the rear panel is secured to the front panel immediately adjacent the second fold line to form an interior wall of the pocket entirely defined by the rear panel.

30. An envelope as defined in claim 1, wherein the rear panel is free of any lines of weakness or flaps.

* * * * *